US006820881B1

(12) United States Patent
Berry

(10) Patent No.: US 6,820,881 B1
(45) Date of Patent: Nov. 23, 2004

(54) SKATEBOARD BRAKE

(76) Inventor: Gregory A. Berry, 516 San Vicente Blvd. #208, Santa Monica, CA (US) 90402

( * ) Notice: Subject to any disclaimer, the term of this patent is extended or adjusted under 35 U.S.C. 154(b) by 0 days.

(21) Appl. No.: 10/224,363

(22) Filed: Aug. 21, 2002

(51) Int. Cl.[7] ..... B62M 1/00
(52) U.S. Cl. ..... 280/87.042; 180/20
(58) Field of Search ..... 280/87.01, 87.021, 280/87.041, 87.042, 87.043, 87.05, 87.03, 809, 842, 11.211; 180/180, 181; 188/17, 19, 20, 206 R, 218 R, 218 XL, 250 R, 550 A, 265

(56) References Cited

U.S. PATENT DOCUMENTS 3,288,251 A 11/1966 Sakwa ..... 188/29
3,945,655 A * 3/1976 Banks et al. ..... 280/11.215
4,027,890 A * 6/1977 Volkmann ..... 280/11.207
4,037,852 A 7/1977 Bayer et al.
4,055,234 A * 10/1977 Burton ..... 188/2 R
4,084,831 A 4/1978 Akonteh et al.
4,295,547 A * 10/1981 Dungan ..... 188/2 R
4,951,958 A * 8/1990 Chao ..... 280/87.041
5,020,621 A * 6/1991 Martin ..... 180/181
D346,418 S * 4/1994 Fischbach ..... D21/765
6,123,348 A * 9/2000 Miller ..... 280/87.042
6,296,082 B1 * 10/2001 Tsai ..... 188/19
6,488,296 B2 * 12/2002 Ireton ..... 280/87.042
2002/0079662 A1 * 6/2002 Lee ..... 280/87.041

* cited by examiner

*Primary Examiner*—Bryan Fischmann
(74) *Attorney, Agent, or Firm*—Edgar W. Averill, Jr.

(57) ABSTRACT

A brake assembly affixed to a skateboard. A brake drum is held to an inner surface of one of the wheels of the skateboard and has an outwardly facing braking surface. A brake pad is held between the underside of the board and the outwardly facing braking surface. A brake pedal extends through an opening in the skateboard. When the brake pedal is depressed, the brake pad moves downwardly and contacts the outwardly facing braking surface, thereby slowing the wheel to which the brake drum is affixed.

10 Claims, 2 Drawing Sheets

SKATEBOARD BRAKE

BACKGROUND OF THE INVENTION

The field of the invention is sporting goods and the invention relates more particularly to skateboards. Skateboards typically are not equipped with any sort of brakes and for the most common style of skateboards, such brakes are generally inappropriate. There has, however, been a style of skateboard which is growing in popularity, referred to as "long boards." Long boards are, as the name applies, longer than standard skateboards and are more commonly used for transportation than for tricks. When a long board is being ridden down a relatively steep or long hill, the speed of the board can often reach that which makes the rider uncomfortable and unsafe. For such long boards and for many uses of standard skateboards, a means of slowing down the skateboard without having to get off the board would be useful.

In spite of the lack of interest for brakes for conventional skateboards, there have been designs of brakes patented. One such design is shown in U.S. Pat. No. 3,288,251. The version shown in FIGS. 2, 3, and 4 of this patent uses a pair of brake pads 28 which rub against the outer surface of the wheels. The version shown in FIGS. 5, 6, and 7 utilizes a different shape of brake pad, but also rub against the outer surface of both wheels.

U.S. Pat. No. 4,037,852 shows a skateboard with a brake with a lever which is located over the rear truck. When the lever is pressed down, the braking element 30 will contact wheels 14 and 15 at points 30*b*' and 30*b*'. The version shown in FIG. 3 has two brake pads on each side 55*a*, which move outwardly and contact the inner face of the wheel. In FIG. 4 there is another embodiment where pins 80 and 90 come into friction contact with the interior assembly of the rear wheels.

U.S. Pat. No. 4,084,831 shows a skateboard brake with a braking pedal 96 near the front truck of the board. When this pedal is depressed, a bar rubs against the top of one of the front wheels. There are numerous disadvantages to having a brake which rubs against the outer surface of the skateboard wheel. First of all, it can damage the wheel. Secondly, the wheel is often contaminated with water or dirt and this can have a major effect on the braking force exerted by rubbing on the outer surface of the wheel.

One of the problems with any skateboard braking surface is the movement which the skateboard truck axle makes during the normal riding operation of the board. In other words, the board is intended to tip with respect to the ground surface, since this is the manner in which the skateboard is turned. Any braking pad which is held by the board itself, therefore, moves with respect to the wheel as the board is turned. It must, therefore, be designed with a great deal of leeway to permit contact between the board and the axle when they are independently movable.

BRIEF SUMMARY OF THE INVENTION

It is an object of the present invention to provide a brake assembly for skateboards which is capable of providing a slowing action on a skateboard wheel without damaging the wheel while still compensating for the independent movement of the board versus the wheel.

The present invention is for a brake assembly affixed to a skateboard having a board with a pair of truck assemblies affixed to an underside thereof. Each of the truck assemblies has a pair of wheels rotatingly held at the ends of axle portions of the truck assemblies. One of these wheels is a braking wheel which has a brake drum held to an inner surface. The brake drum has an outwardly facing braking surface. A brake pad support plate is held between the underside of the board and the brake drum and is biased toward the underside and away from the brake drum. A brake pad is affixed to the brake pad support plate so that when the brake pad support plate is moved downwardly, it contacts the outwardly facing braking surface, exerting a braking force on the braking wheel. Preferably, the brake pad support plate is operated by an actuating arm which extends through the board to a pedal which is depressed when braking is desired. A slotted metal plate is preferably used to hold the brake pad. The slotted metal plate is held between one of the truck assemblies and the underside of the board. It is made from a flexible material so that the brake pad moves away from the brake drum when force on the pedal is removed.

DESCRIPTION OF THE PREFERRED EMBODIMENTS

Figure 1:
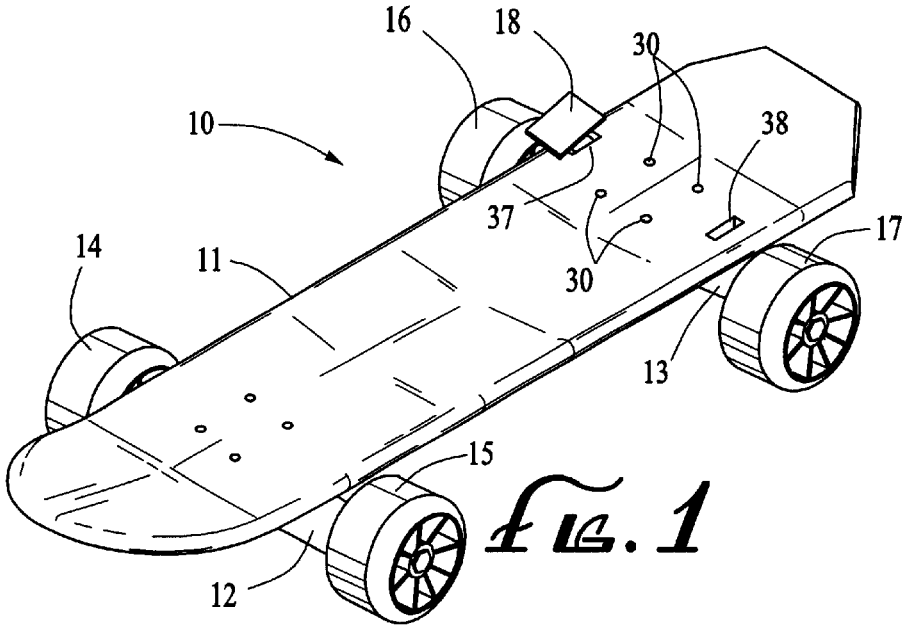
FIG. 1 is a perspective view of a skate board, including a brake of the present invention.
Figure 2:
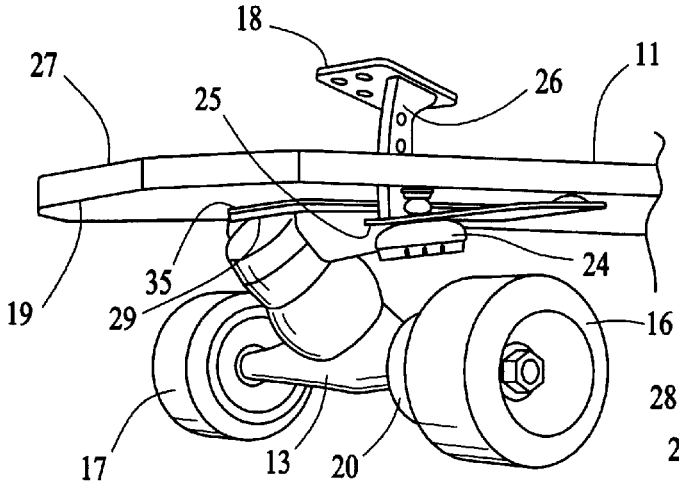
FIG. 2 is an enlarged perspective view of the right rear of the skateboard of FIG. 1.

A skateboard 10 is shown in FIG. 1, and has a board 11 which holds two truck assemblies 12 and 13. Front truck assembly 12 has two wheels 14 and 15 held by bearings to an axle portion of truck assembly 12. Similarly, rear truck assembly 13 has two wheels 16 and 17 held to an axle of rear truck assembly 13. A brake pedal 18 extends above board 11 and is used to actuate the brake as set forth below. Details of the brake assembly are shown in FIG. 2 where a truck assembly 13 can be seen to be held to the underside 19 of board 11.

A brake drum 20 is affixed to wheel 16 which, thus, becomes a braking wheel. The method of attachment is shown best in FIG. 5, where it can be seen that the brake drum 20 has an outwardly facing braking surface 21. Drum 20 is held to hub 22 of wheel 16 by a plurality of screws 23, although other holding methods can, of course, be used. For instance, the brake drum 20 could be an integral part of an aluminum wheel hub. Alternatively, the brake drum might be an integral part of a polymeric hub with appropriate outer braking surface formed thereon.

Returning to FIG. 2, a brake pad 24 is held to a brake pad support plate 25. Brake pad support plate 25 is biased upwardly and also supports an actuating arm 26 which holds pedal 18 above the upper surface 27 of board 11.

Figure 3:
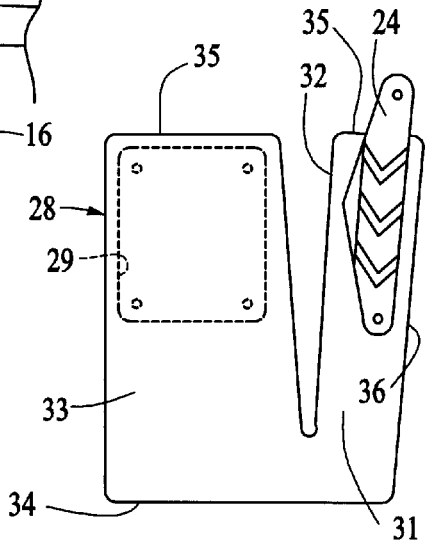
FIG. 3 is an underside view of the brake pad support plate of the skateboard of FIG. 1.
Figure 4:
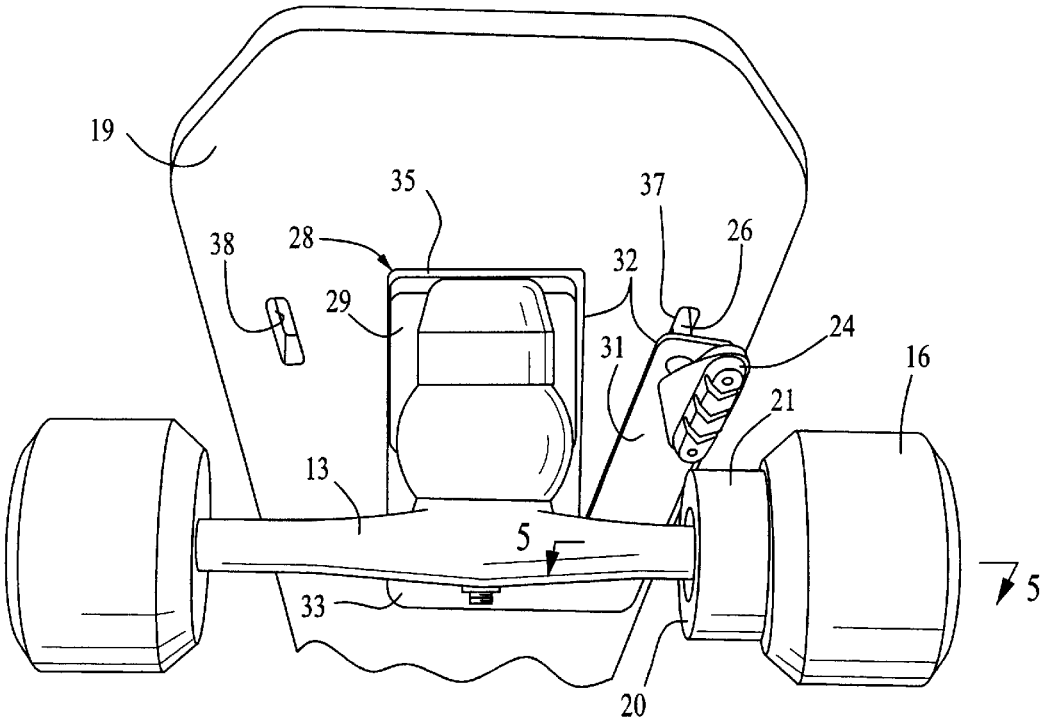
FIG. 4 is a perspective view showing the underside of the rear of the skateboard of FIG. 1.

The biasing force of brake pad 24 is supplied by the bending of middle portion 31 of brake pad support plate 25 portion of metal plate 28 as shown in FIG. 3. Plate 28 may be fabricated from aluminum but need not be fabricated from metal, but may be made from any stiff but flexible material.

Plate 28 is held to the underside 19 of board 11 by being placed under the upper support flange 29 of truck assembly 13. This is shown in phantom view in FIG. 3 and provides a very secure way of holding plate 28 in place. The screws indicated by reference character 30 in FIG. 1 securely hold the truck assembly, and thus, securely hold plate 28 in place.

The flexibility of the flexible arm portion 31 is formed in plate 28 by the use of slot 32. Slot 32 divides plate 28 into a secured portion 33 and a flexible portion 31. Plate 28 has an inner edge 34, an outer rear edge 35 and an outer side edge 36. Slot 32 shown in FIG. 3 is generally V-shaped, being wider at the outer rear edge 35 and narrower as it nears the inner edge 34. This provides a more equal bending of flexible arm portion 31 than if the slot had parallel sides.

One of the beneficial features of the use of plate 28 is that it can be readily reversed so that the pedal 18 may extend through either opening 37 or opening 38, depending on the way in which the rider rides the skateboard. Slot 32 shown in FIG. 3 is generally V-shaped, being wider at the outer rear edge 35 and narrower as it nears the inner edge 34. This provides a more equal bending of flexible arm portion 31 than if the slot had parallel sides.

Figure 5:
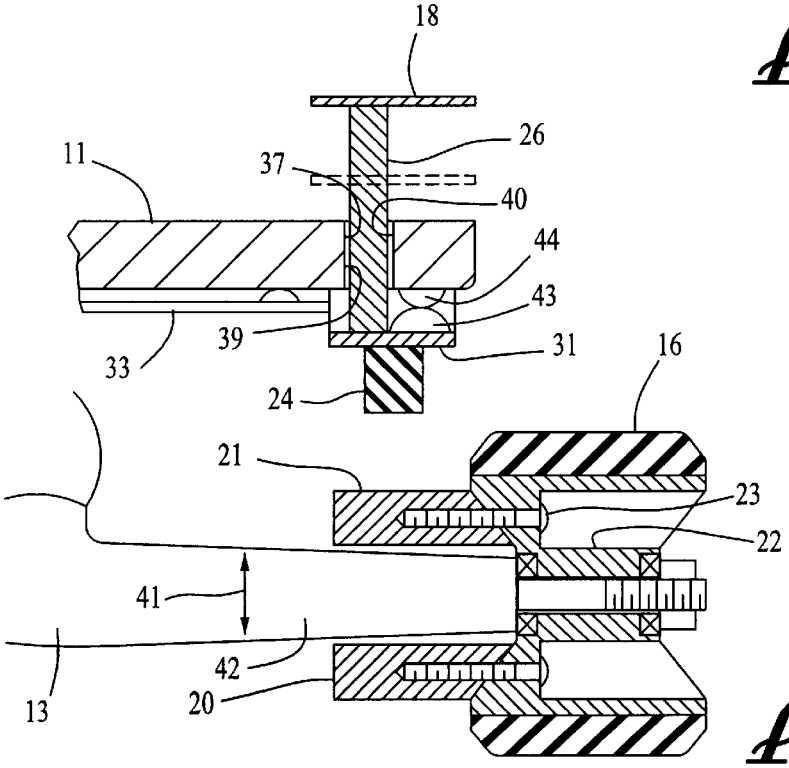
FIG. 5 is a cross-sectional view taken along line 5—5 of FIG. 4.

As shown in FIG. 5, actuating arm 26 passes through opening 37 which has two sides 39 and 40. These sides provide guidance to actuating arm 26 so that it generally incapable of moving very far in a side to side direction and is basically guided into moving in only a vertical direction.

As shown in FIG. 5 by the arrow 41, the axle portion 42 of truck assembly 13 moves up and down during riding. Therefore, the brake pad 24 must be capable of making contact with the outwardly facing braking surface 21, even though axle portion 42 is often moving. This is accomplished by providing a relatively large spacing between brake pad 24 and braking surface 21 and a relatively long actuating arm so that the rider may keep pressure on the pedal 18, even though the board may be moving with respect to axle 42.

The brake pad support plate or flexible arm 31 preferably has an upper stop 43 which abuts a pad 44 to protect the underside of board 11.

In the drawings, the brake pad is shown as a rubber pad. It is, of course, that the brake pad could be made from composite braking materials or metal and the brake drum is made from a more flexible material, such as rubber.

While the plate 28 provides an especially easy-to-install, durable, and inexpensive mounting system, other biasing means may, of course, be utilized. While the brake is shown on one of the rear wheels, it could alternatively be placed on one of the front wheels.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A brake assembly affixed to a skateboard having a board with a pair of truck assemblies affixed to an underside thereof, each of said truck assemblies having a pair of wheels rotatingly held at ends of axle portions of said truck assemblies, one of said wheels being a braking wheel, said brake assembly comprising:

a brake drum held to an inner surface of said braking wheel, said brake drum having an outwardly facing braking surface;

a brake pad support plate held between the underside of said board and said brake drum, said brake pad support plate being biased in the direction toward said underside and away from said brake drum;

a brake pad affixed to said brake pad support plate so that when said brake pad support plate is moved downwardly, the brake pad contacts said outwardly facing braking surface exerting a braking force on said braking wheel; and means for exerting a downward force on said brake pad support plate.

2. The brake assembly affixed to a skateboard of claim 1 wherein said means for exerting a downward force on said brake pad support plate comprises an actuating arm affixed to said brake pad support plate and said actuating arm extending through an opening in said board and extending above an upper surface of said board and terminating in a brake pedal.

3. The brake assembly affixed to a skateboard of claim 2 wherein said actuating arm is generally rectangular in cross-sectional shape and has two outer surfaces and said opening in said board has two sides which are spaced a short distance from said two outer surfaces of said actuating arm so that sideways movement of said actuating arm is limited by contact between the outer surfaces of the actuating arm and the sides of the opening in the board.

4. The brake assembly affixed to a skateboard of claim 1 wherein said brake pad support plate is biased in the direction of said underside of said board by being fabricated from a flexible arm having a securement end and a brake pad end and said securement end being held to said board and said brake pad end being cantilevered so that it can move up and down as the flexible arm bends.

5. The brake assembly affixed to a skateboard of claim 4 wherein said flexible arm is formed from a portion of a brake plate fabricated from a stiff but flexible material having a secured portion held between the underside of said board and a truck assembly board support face and a portion of said brake plate extending from its outer rear edge inwardly past said truck assembly board support face to an inner edge, and said brake plate extending toward a side of said board extending over at least a portion of said brake drum to a brake plate outer side edge and said brake plate having a slot extending from said outer rear edge toward said brake plate inner edge, said slot dividing said brake plate into a flexible arm portion and a secured portion and said flexible arm portion forming said brake pad support plate.

6. The brake assembly affixed to a skateboard of claim 5 wherein said slot is generally "V" shaped being wider at said outer rear edge of said brake plate and narrower near said brake plate inner edge.

7. The brake assembly affixed to a skateboard of claim 5 wherein said brake plate is fabricated from aluminum.

8. A brake assembly affixed to a skateboard having a board with a forward and a rear truck assembly affixed to an underside thereof, each of said truck assemblies having a pair of wheels rotatingly held at ends of axle portions of said truck assemblies, one of said wheels on said rear truck assembly being a braking wheel, said brake assembly comprising:

a brake drum held to an inner surface of said braking wheel, said brake drum having an outwardly facing braking surface;

a brake pad support plate held between the underside of said board and said brake drum, said brake pad support plate being biased in the direction toward said underside and away from said brake drum;

a brake pad affixed to said brake pad support plate so that when said brake pad support plate is moved downwardly, the brake pad contacts said outwardly facing braking surface exerting a braking force on said braking wheel; and means for exerting a downward force on said brake pad support plate comprising an actuating arm affixed at a lower end to said brake pad support plate and extending upwardly therefrom through an opening in said board and extending further upwardly to a brake pedal.

9. The brake assembly affixed to a skateboard of claim 8 wherein said brake pad support plate is biased in the direction of said underside of said board by being fabricated from a flexible arm having a securement end and a brake pad end and said securement end being held to said board and said brake pad end being cantilevered so that it can move up and down as the flexible arm bends and wherein said flexible arm is formed from a portion of a brake plate fabricated from a stiff but flexible material having a secured portion held between the underside of said board and a truck assembly board support face and a portion of said brake plate extending from its outer rear edge inwardly past said truck assembly board support face to an inner edge, and said brake plate extending toward a side of said board extending over at least a portion of said brake drum to a brake plate outer side edge and said brake plate having a slot extending from said outer rear edge toward said brake plate inner edge, said slot dividing said brake plate into a flexible arm portion and a secured portion and said flexible arm portion forming said brake pad support plate.

10. The brake assembly affixed to a skateboard of claim 8 wherein said board has two openings, one adjacent a right side of said board and one adjacent a left side of said board and wherein said brake pad support plate may be affixed in a first orientation so that the actuating arm passes through the opening adjacent the right side and may be removed and turned over and affixed in a second orientation so that the actuating arm passes through the opening adjacent the left side.

* * * * *